US007841049B2

(12) United States Patent
Wang

(10) Patent No.: US 7,841,049 B2
(45) Date of Patent: Nov. 30, 2010

(54) HINGE ASSEMBLY

(75) Inventor: Chia-Ming Wang, Shenkeng Township, Taipei County (TW)

(73) Assignee: Sallas Industrial Co., Ltd., Taipei County (TW)

( * ) Notice: Subject to any disclaimer, the term of this patent is extended or adjusted under 35 U.S.C. 154(b) by 379 days.

(21) Appl. No.: 12/149,972

(22) Filed: May 12, 2008

(65) Prior Publication Data

US 2009/0276976 A1 Nov. 12, 2009

(51) Int. Cl.
*E05D 7/04* (2006.01)

(52) U.S. Cl. ..... 16/284; 16/238; 16/241; 16/245; 16/326; 16/371

(58) Field of Classification Search ..... 16/238–241, 16/284, 245, 246, 248, 249, 326, 350–353, 16/371, 300, 301, 303, 316
See application file for complete search history.

(56) References Cited

U.S. PATENT DOCUMENTS 2,702,401 A * 2/1955 Vigmostad et al. ..... 16/302
3,965,533 A * 6/1976 Frohlich ..... 16/300
4,291,914 A * 9/1981 Mizelle ..... 297/362.14
4,751,765 A * 6/1988 Wu ..... 16/256
4,881,299 A * 11/1989 Young et al. ..... 16/371
5,000,170 A * 3/1991 Young et al. ..... 602/16
5,029,363 A * 7/1991 Hesener ..... 16/241
5,035,026 A * 7/1991 Carlo et al. ..... 16/288
5,074,609 A * 12/1991 Dear ..... 296/76
5,507,719 A * 4/1996 Freeman ..... 602/26
5,873,619 A * 2/1999 Lewkoski et al. ..... 296/76
5,967,586 A * 10/1999 Duffy et al. ..... 296/76
7,516,519 B2 * 4/2009 Talpe ..... 16/316

* cited by examiner

*Primary Examiner*—Chuck Y. Mah
(74) *Attorney, Agent, or Firm*—Rosenberg, Klein & Lee

(57) ABSTRACT

A hinge assembly includes a first swinging member, a second swinging member that has a barrel at one end, a pivot pin inserted through the barrel to pivotally secure the second swinging member to a proximal end of the first swinging member, a guide member, which has a first end inserted through an oblique guide slot on the barrel and pivotally coupled to the pivot pin and a second end provided with a transversely extending screw hole, and an adjustment screw transversely inserted through the proximal end of the first swinging member and threaded into the screw hole of the guide member for allowing rotation by a user to bias the second swinging member relative to the first swinging member.

7 Claims, 7 Drawing Sheets

HINGE ASSEMBLY

BACKGROUND OF THE INVENTION

1. Field of the Invention

The present invention relates to hinges and more particularly, to a hinge assembly, which allows easy and accurate adjustment of the angle between the two swinging members thereof by means of an adjustment screw.

2. Description of the Related Art

FIG. 1 shows a hinge assembly 10 according to the prior art. According to this design, the hinge assembly 10 is comprised of a first swinging member 11, a second swinging member 12, a pivot pin 13, and a limiter screw 14. The first swinging member 11 comprises two wing plates 111 arranged at two sides of one end thereof, and a shield 113 connected between the wing plates 111. Each wing plate 111 has a through hole 112. The shield 113 has a screw hole 114. The second swinging member 12 comprises a pivot holder 121 at one end. The pivot holder 121 has a through hole 122 axially extending through two opposite ends thereof. The pivot pin 13 is inserted through the through holes 112 of the wing plates 111 and the through hole 122 of the pivot holder 121 to pivotally secure the second swinging member 12 to the first swinging member 11. The limiter screw 14 is threaded into the screw hole 114 of the shield 113 and stopped against the periphery of the pivot holder 121 to limit the biasing angle of the second swinging member 12 relative to the first swinging member 11.

The aforesaid hinge assembly 10 allows adjustment of the angle of the second swinging member 12 relative to the first swinging member 11. According to this design, the adjustment accuracy of the biasing angle of the second swinging member 12 relative to the first swinging member 11 depends upon the user's technique. Further, the use of the limiter screw 14 to limit the biasing angle of the second swinging member 12 relative to the first swinging member 11 does not allow the hinge assembly 10 to bear a heavy load. Further, the limiter screw 14 and the surface of the pivot holder 121 wear quickly with use. When the limiter screw 14 and the surface of the pivot holder 121 start to wear, the positioning between the first swinging member 11 and the second swinging member 12 becomes unstable.

SUMMARY OF THE INVENTION

The present invention has been accomplished under the circumstances in view. It is one object of the present invention to provide a hinge assembly, which utilizes an adjustment screw for adjusting the angle between a first swinging member and a second swinging member conveniently and accurately.

It is another object of the present invention to provide a hinge assembly, which is durable in use and capable of bearing a heavy load.

According to one aspect of the present invention, the hinge assembly comprises a first swinging member, which comprises a plurality of wing plates arranged at two opposite lateral sides of a proximal end thereof and a plurality of first through holes and second through holes transversely cut through the wing plates, a second swinging member, which comprises a barrel transversely and fixedly disposed at a proximal end thereof, which barrel comprising two through holes respectively disposed at two opposite ends thereof and an oblique guide slot which is arranged obliquely in the direction of an axis of said barrel cut through the periphery thereof, a guide member, which comprises a first end, a second end opposing the first end inserted through the oblique guide slot into the inside of the barrel, a screw hole transversely extending through the first end, and a through hole transversely extending through the second end, a pivot pin, which is inserted through two first through holes of the wing plates of the first swinging member and the through holes of the barrel and the through hole of the guide member to pivotally secure the first swinging member and the second swinging member and the guide member together, and an adjustment screw, which is inserted through two second through holes of the wing plates of the first swinging member and threaded into the screw hole of the guide member and rotatable to bias the second swinging member relative to the first swinging member. The engagement between the adjustment screw and the screw hole of the guide member enhances the durability and load-bearing capability of the hinge assembly.

According to another aspect of the present invention, a C-shaped retainer is fastened to one end of the adjustment screw to secure the adjustment screw to the first swinging member, avoiding falling of the adjustment screw from the first swinging member.

According to still another aspect of the present invention, the first swinging member comprises a holder frame fixedly provided at a distal end thereof opposite to the proximal end.

According to still another aspect of the present invention, the second swinging member comprises a plurality of mounting screw holes symmetrically disposed at two opposite lateral sides thereof for mounting.

According to still another aspect of the present invention, the first swinging member comprises a shield connected between two wing plates at the proximal end thereof. The shield has a transversely extending elongated slot. Further, the guide member comprises a pointer protruded from the first end thereof and suspending in the transversely extending elongated slot of the shield and movable with the guide member along the transversely extending elongated slot of the shield.

According to still another aspect of the present invention, the sensitivity of the adjustment of the angle between first and second swinging members thereof is determined subject to the sloping angle of an oblique guide slot on a barrel at the second swinging member and the tooth pitch of the adjustment screw and the screw hole.

DETAILED DESCRIPTION OF THE PREFERRED EMBODIMENT

Figure 1:
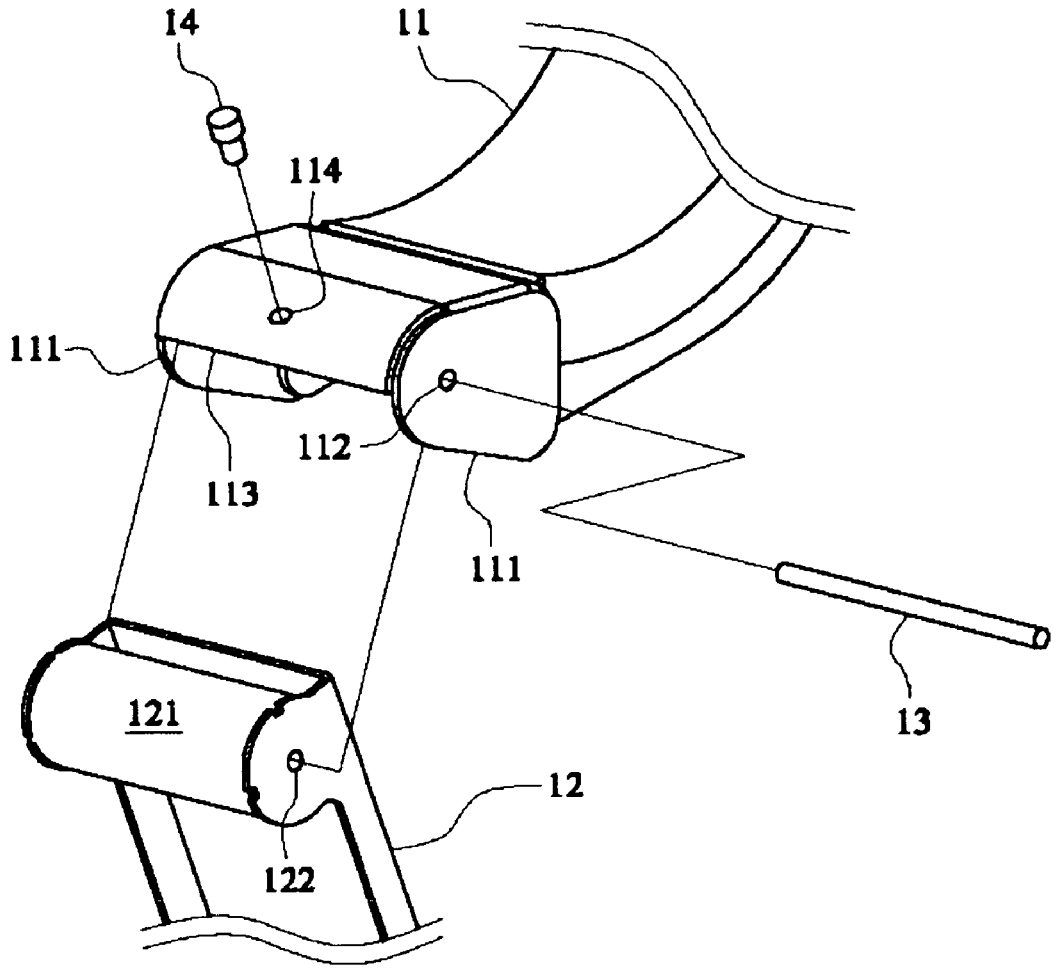
FIG. 1 (Prior Art)
FIG. 1 is an exploded view of a hinge assembly according to the prior art.
Figure 2:
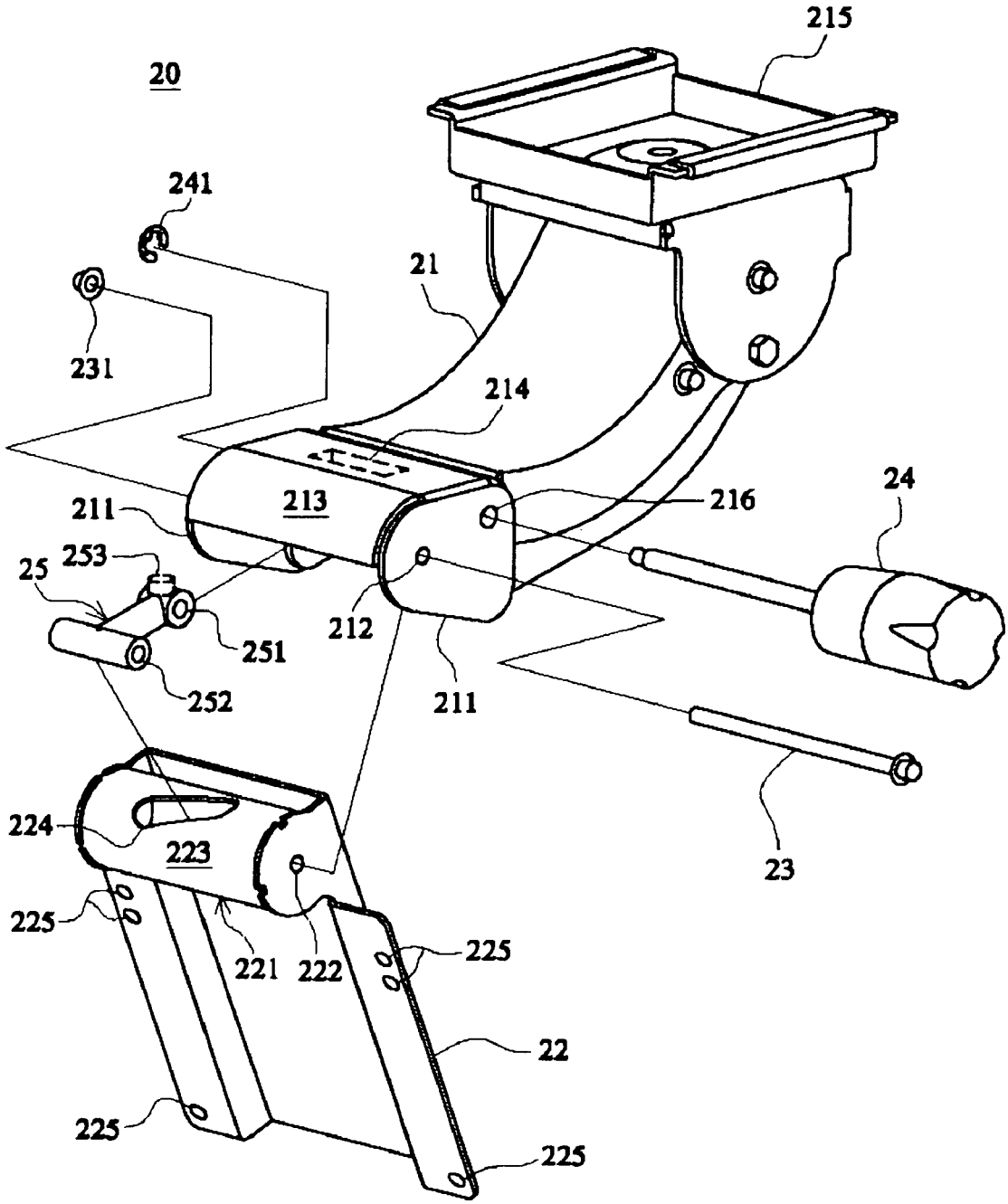
FIG. 2 is an exploded view of a hinge assembly in accordance with the present invention.
Figure 3:
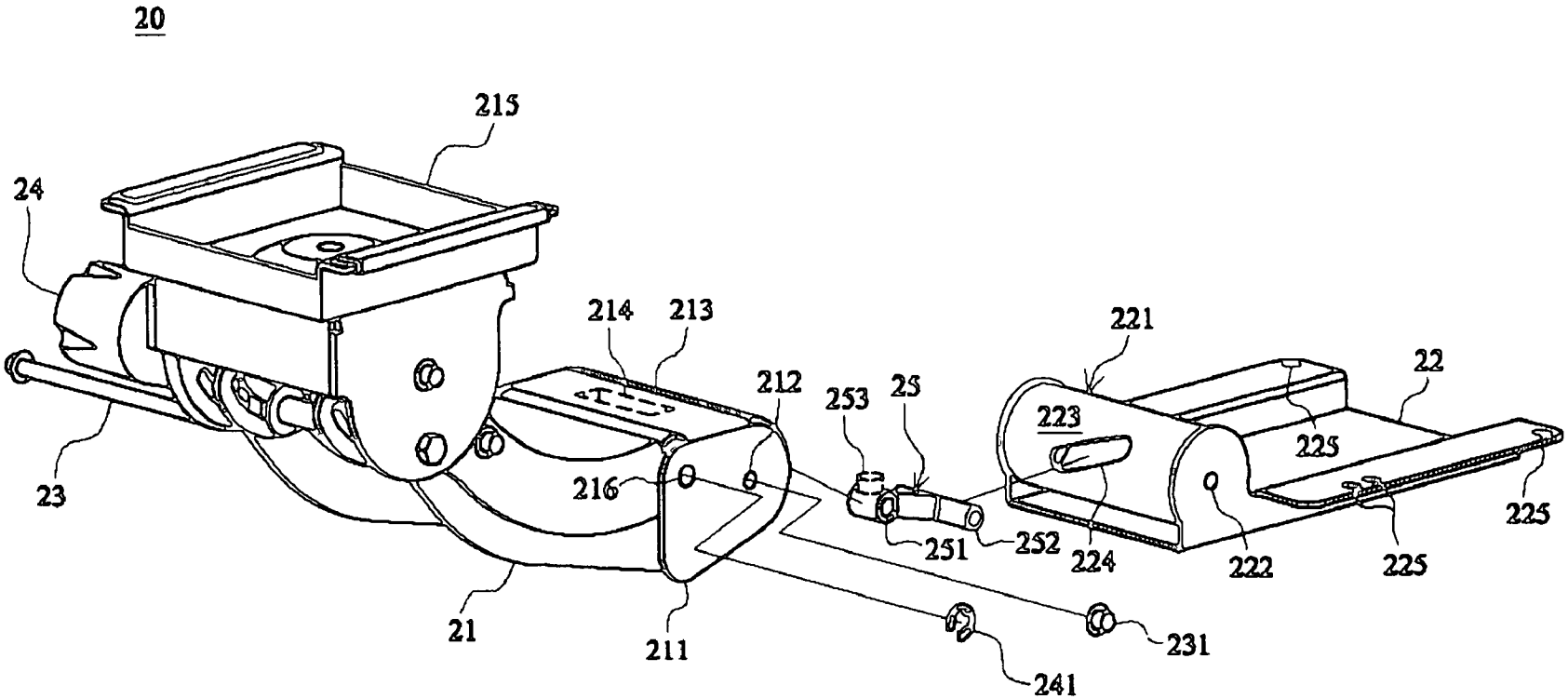
FIG. 3 is an exploded view of the hinge assembly in accordance with the present invention when viewed from another angle.
Figure 4:
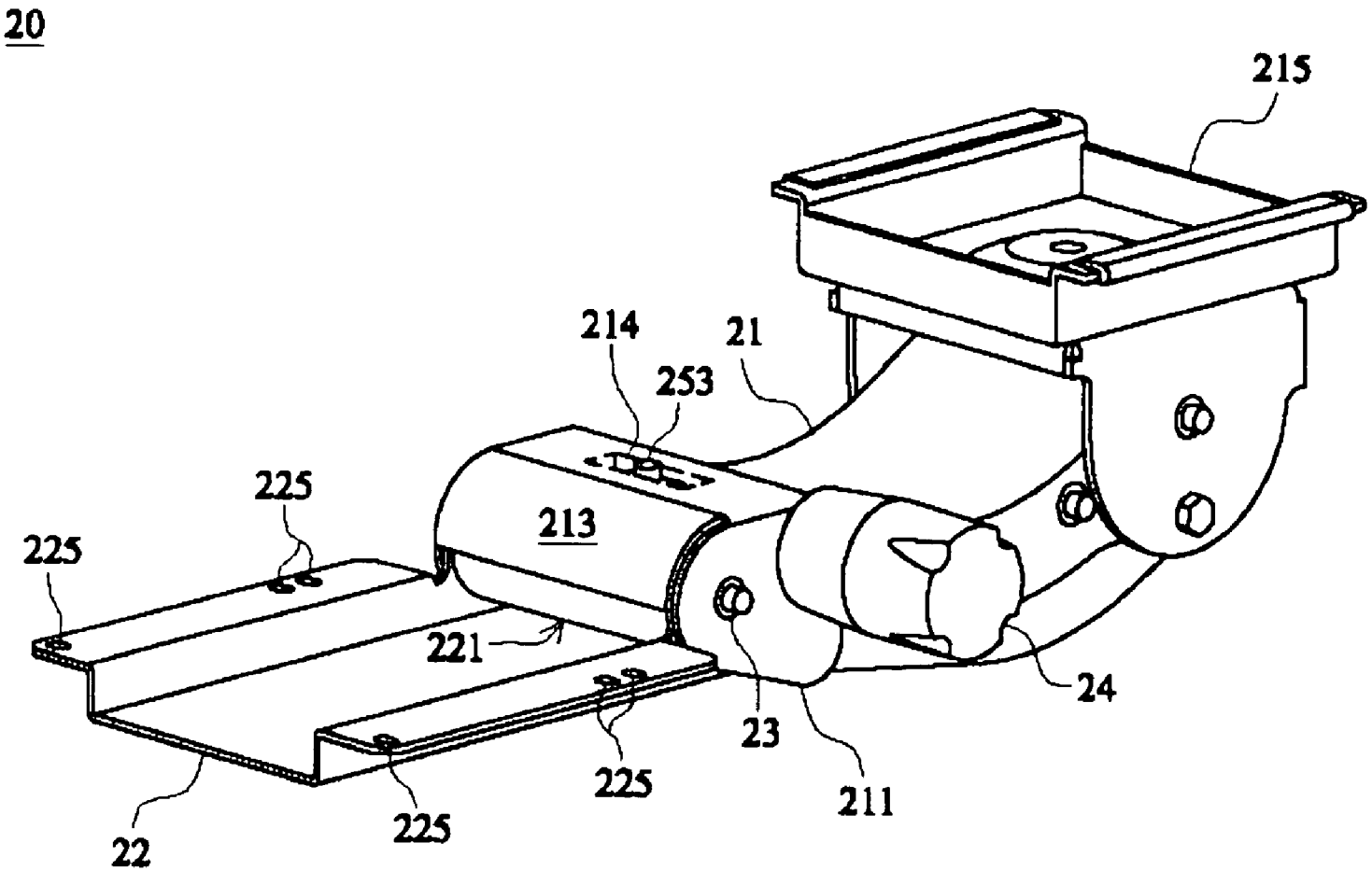
FIG. 4 is an elevational assembly view of the hinge assembly in accordance with the present invention.

Referring to FIGS. 2-4, a hinge structure 20 is shown comprised of a first swinging member 21, a second swinging member 22, a guide member 25, a pivot pin 23 and an adjustment screw 24. The first swinging member 21 comprises a plurality of wing plates 211, for example, two wing plates 211 bilaterally and symmetrically disposed at one end. Each wing plate 211 has a first through hole 212 and a second through hole 216. The second swinging member 22 comprises a barrel 221 transversely and fixedly disposed at one end thereof, two through holes 222 formed on the two opposite ends thereof and an oblique guide slot 224 which is arranged obliquely in the direction of an axis of said barrel 221 cut through the periphery 223 of the barrel 221. The guide member 25 has a screw hole 251 transversely disposed at the front side thereof, a through hole 252 transversely disposed at the rear side thereof. The front side of the guide member 25 is inserted through the oblique guide slot 224 into the inside of the second swinging member 22. The pivot pin 23 is inserted through the first through holes 212 of the first swinging member 21, the through hole 222 of the barrel 221 of the second swinging member 22 and the through hole 252 of the guide member 25 to pivotally secure the first swinging member 21, the second swinging member 22 and the guide member 25 together. The adjustment screw 24 according to the present preferred embodiment is a hand screw inserted through the second through holes 216 of the first swinging member 21 and threaded into the screw hole 251 of the guide member 25 to secure the guide member 25 to the first swinging member 21, allowing the second swinging member 22 to be turned about the axis of the screw hole 251 (i.e., the adjustment screw 24) relative to the first swinging member 21.

Figure 5:
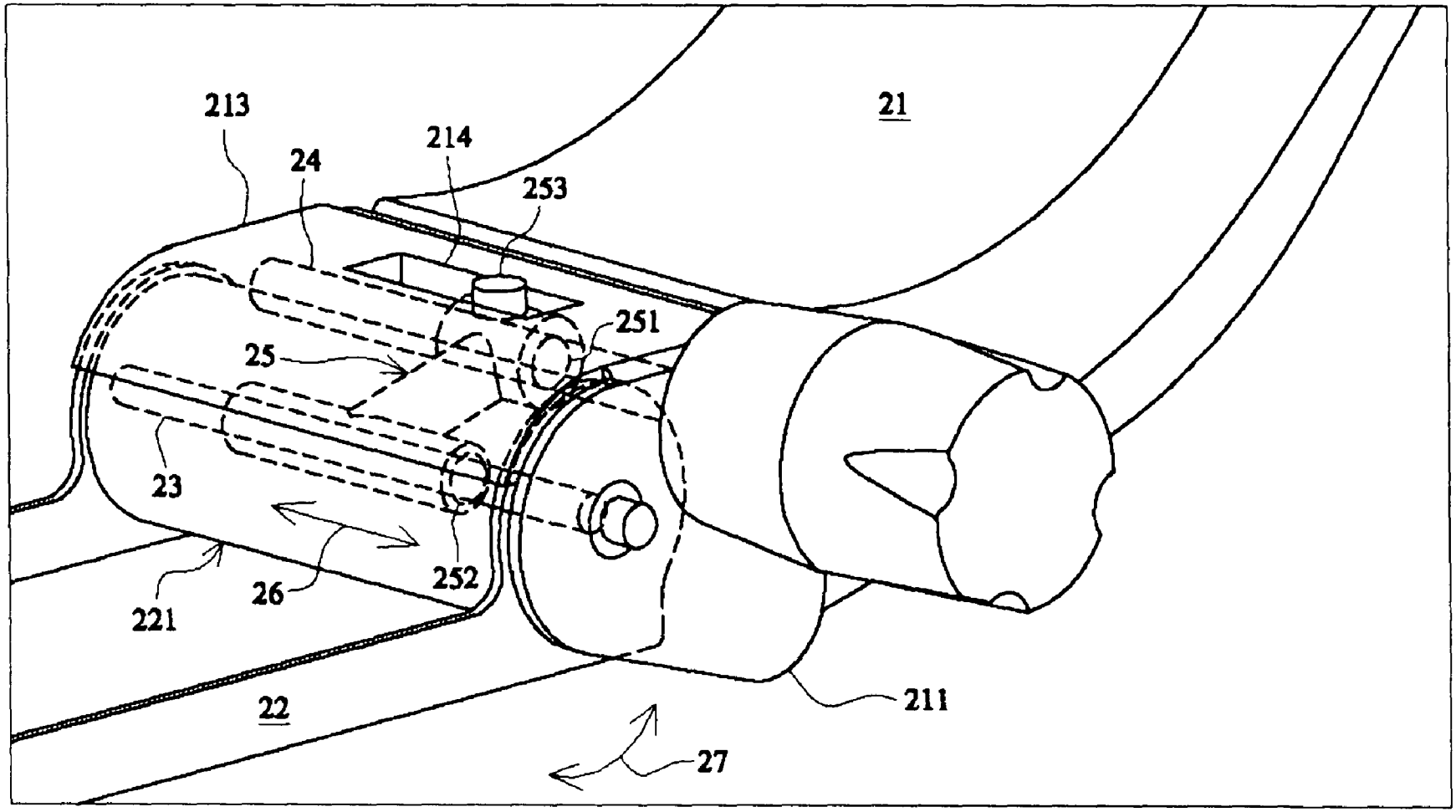
FIG. 5 is a perspective view in an enlarged scale of a part of FIG. 4.
Figure 6:
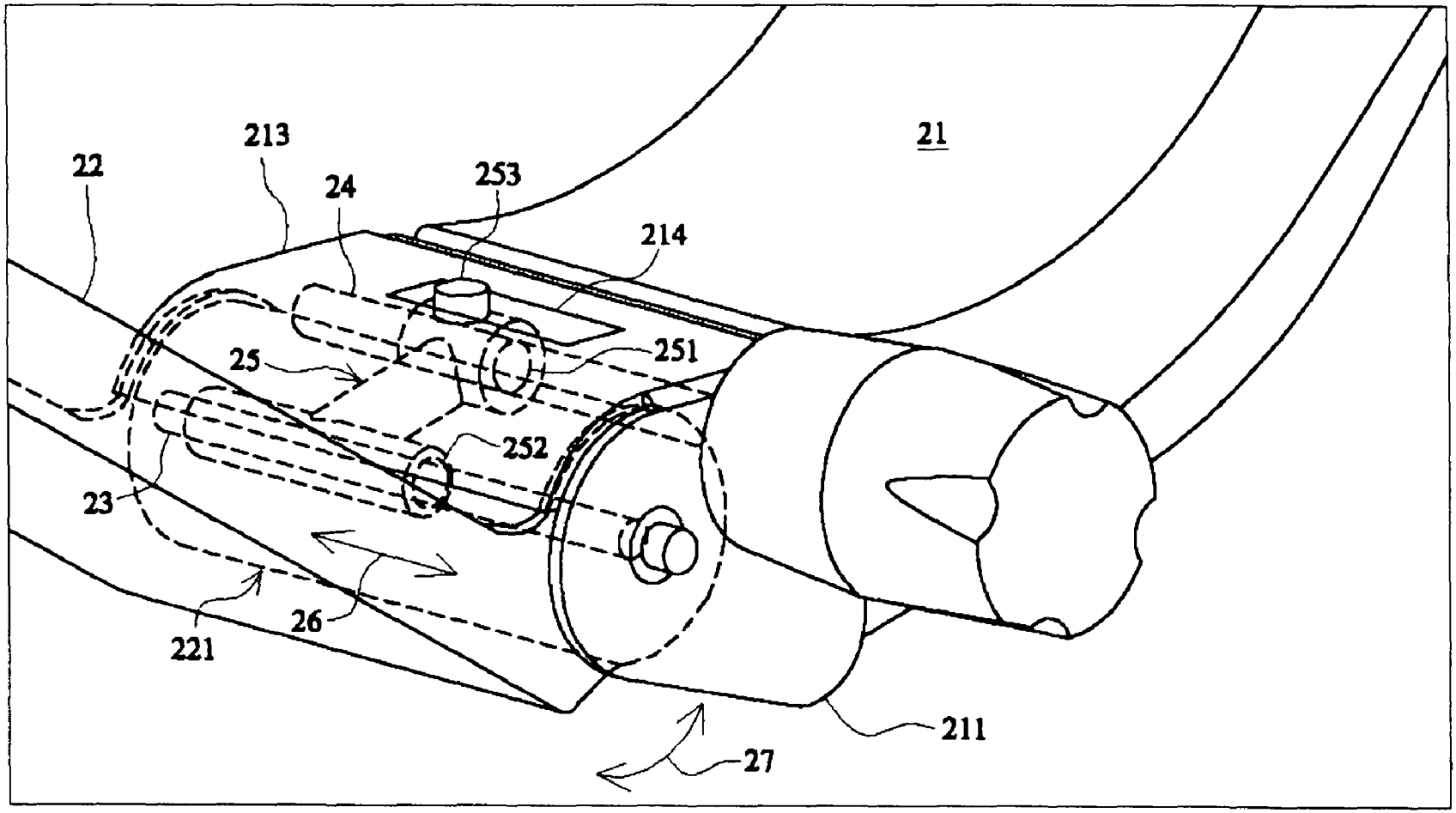
FIG. 6 corresponds to FIG. 5, showing the angle of the hinge assembly adjusted.

Referring to FIGS. 5 and 6 and FIGS. 2 and 3 again, when rotating the adjustment screw 24, the guide member 25 is moved along the adjustment screw 24 and the pivot pin 23 in a first direction 26 and also moved along the oblique guide slot 224, and the second swinging member 22 is forced to turn about the adjustment screw 24 relative to the first swinging member 21 in a second direction 27.

Referring to FIGS. 2-4 again, by means of engagement between the adjustment screw 24 and the screw hole 251, a user can rotate the adjustment screw 24 to adjust the angle of the second swinging member 22 relative to the first swinging member 21 conveniently and accurately. Further, the sensitivity of the adjustment of the angle of the second swinging member 22 relative to the first swinging member 21 is determined subject to the sloping angle of the oblique guide slot 224 on the periphery 223 of the barrel 221 of the second swinging member 22 and the tooth pitch of the adjustment screw 24 and the screw hole 251.

Further, the hinge assembly 20 of the present invention can bear a heavy load. The engagement between the adjustment screw 24 and the screw hole 251 enhances the durability and load-bearing capability of the hinge assembly 20.

Figure 7:
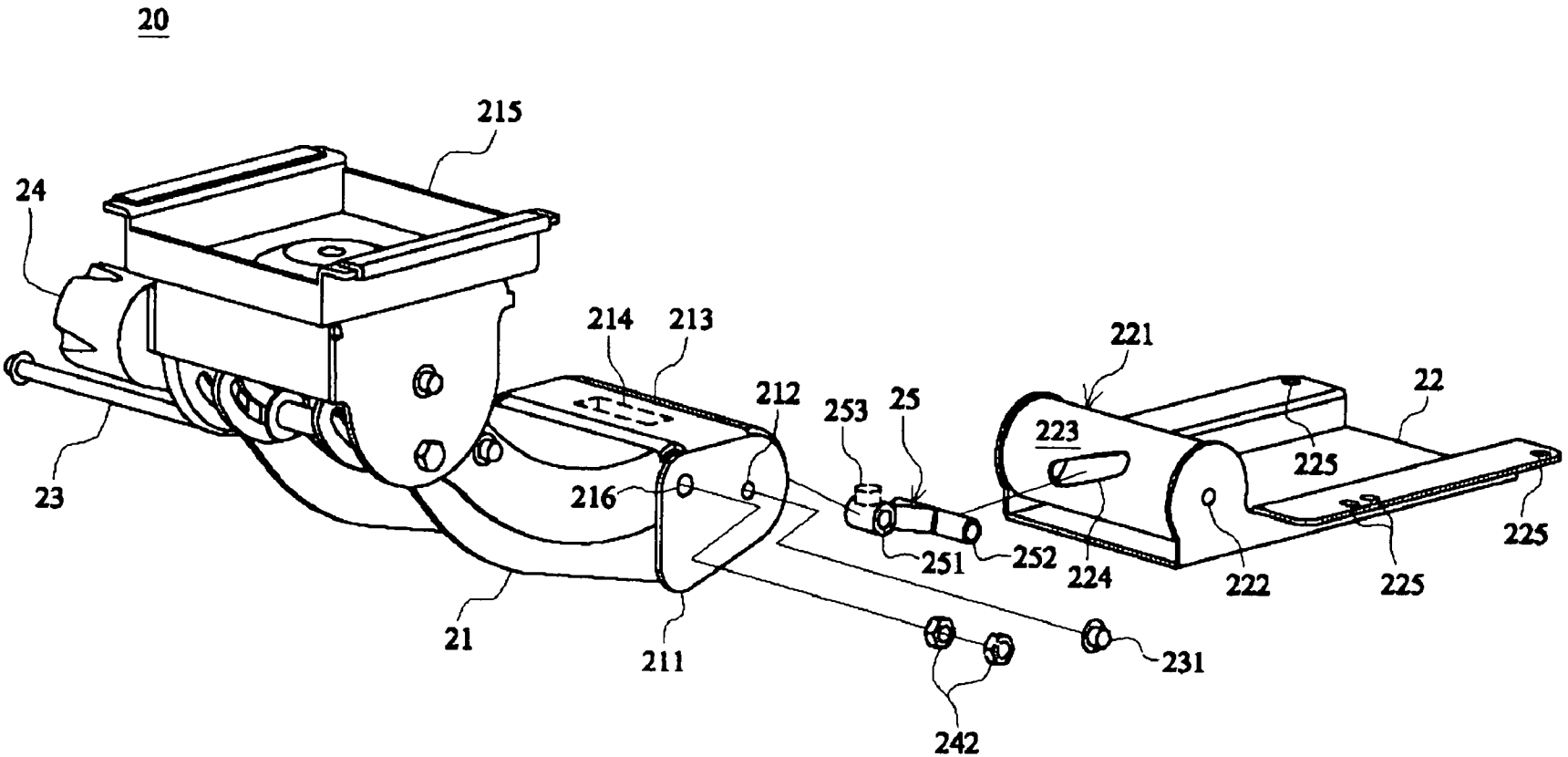
FIG. 7 is an exploded view of the hinge assembly in accordance with the present invention when viewed from another angle.

Further, a C-shaped retainer 241 is fastened to the end of the adjustment screw (hand screw) 24 to secure the adjustment screw 24 to the first swinging member 21, avoiding falling of the adjustment screw 24 from the first swinging member 21. Referring to FIG. 7, alternatively, at least one screw nut 242 can be used and threaded onto the end of the adjustment screw 24 to secure the adjustment screw 24 to the first swinging member 21.

Further, a retainer 231 is fastened to the end of the pivot pin 23 to secure the pivot pin 23 to the first swinging member 21 and the second swinging member 22, avoiding falling of the pivot pin 23 from the swinging member 21 and the second swinging member 22.

The adjustment screw 24 can be a multi-thread adjustment screw having multiple threaded sections for coarse adjustment and fine adjustment.

Referring to FIGS. 2-6 again, the first swinging member 21 comprises a shield 213 connected between the two wing plates 211. The shield 213 has a transversely extending elongated slot 214. The guide member 25 has a pointer 253 upwardly protruded from the front side and suspending in the elongated slot 214. When the operator rotates the adjustment screw 24 to bias the second swinging member 22 relative to the first swinging member 21, the guide member 25 is forced to move along the adjustment screw 24 and the pivot pin 23, and the pointer 253 is moved with the guide member 25 along the elongated slot 214 in the first direction 26 (see FIGS. 5 and 6). By means of the indication of the pointer 253, the user can visually check the adjustment of the adjustment screw 24 in biasing the second swinging member 22 relative to the first swinging member 21.

Further, the hinge assembly 20 of the present invention can be used in any of a variety of fields, for enabling the first swinging member 21 and the second swinging member 22 to be respectively affixed to two different parts of an apparatus so that the user can adjust the contained angle between the two parts of the apparatus conveniently and accurately. For example, the hinge assembly 20 can be used in a camera platform, stand, chair back adjustment mechanism, computer keyboard holder, and etc. For use in a keyboard holder, the first swinging member 21 of the hinge assembly 20 can be equipped with a holder frame 215 at one end remote from the second swinging member 22 for supporting a computer keyboard (not shown). In this case, the second swinging member 22 is held in position, allowing the first swinging member 21 to be biased relative to the second swinging member 22. When rotating the adjustment screw 24 to bias the first swinging member 21 relative to the second swinging member 22, the position of the holder frame 215 and the computer keyboard (not shown) is relatively changed to fit the requirement of a different user. Further, the second swinging member 22 has a plurality of mounting screw holes 225 symmetrically arranged at two opposite lateral sides for fastening to a support with screws, for example, for fastening to the top of a table. After fixation of the second swinging member 22 to a support and loading of a computer keyboard on the holder frame 215, the user can rotate the adjustment screw 24 to adjust the angle of the first swinging member 21 relative t the second swinging member 22, thereby adjusting the angle of the computer keyboard.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A hinge assembly comprising:

a first swinging member, said first swinging member comprising a plurality of wing plates arranged at two opposite lateral sides of a proximal end thereof, and a plurality of first through holes and second through holes transversely cut through said wing plates;

a second swinging member, said second swinging member comprising a barrel transversely and fixedly disposed at a proximal end thereof, said barrel comprising two through holes respectively disposed at two opposite ends thereof and an oblique guide slot which is arranged obliquely in the direction of an axis of said barrel and cut through the periphery thereof;

a guide member, said guide member comprising a first end, a second end opposing said first end inserted through said oblique guide slot into the inside of said barrel, a screw hole transversely extending through said first end, and a through hole transversely extending through said second end;

a pivot pin inserted through two said first through holes of said wing plates of said first swinging member and the through holes of said barrel and the through hole of said guide member to pivotally secure said first swinging member and said second swinging member and said guide member together; and an adjustment screw inserted through two said second through holes of said wing plates of said first swinging member and threaded into the screw hole of said guide member and rotatable to bias said second swinging member relative to said first swinging member.

2. The hinge assembly as claimed in claim 1, wherein the number of said wing plates is 2.

3. The hinge assembly as claimed in claim 1, further comprising a C-shaped retainer or at least one screw nut fastened to one end of said adjustment screw to secure said adjustment screw to said first swinging member.

4. The hinge assembly as claimed in claim 1, wherein said first swinging member comprises a holder frame fixedly provided at a distal end thereof opposite to the proximal end of said first swinging member.

5. The hinge assembly as claimed in claim 1, wherein said second swinging member comprises a plurality of mounting screw holes symmetrically disposed at two opposite lateral sides thereof.

6. The hinge assembly as claimed in claim 1, wherein said first swinging member comprises a shield connected between two said wing plates at the proximal end thereof, said shield having a transversely extending elongated slot; said guide member comprises a pointer protruded from the first end thereof and suspending in the transversely extending elongated slot of said shield and movable with said guide member along the transversely extending elongated slot of said shield.

7. The hinge assembly as claimed in claim 1, further comprising a retainer fastened to one end of said pivot pin to secure said pivot pin to said first swinging member and said second swinging member.

* * * * *